United States Patent [19]

Ohno et al.

[11] Patent Number: 4,802,934

[45] Date of Patent: Feb. 7, 1989

[54] SINGLE-CRYSTAL NI-BASED SUPER-HEAT-RESISTANT ALLOY

[75] Inventors: Takehiro Ohno; Rikizo Watanabe, both of Yasugi, Japan

[73] Assignee: Hitachi Metals, Ltd., Japan

[21] Appl. No.: 927,109

[22] Filed: Nov. 5, 1986

[30] Foreign Application Priority Data

Nov. 18, 1985 [JP] Japan ..... 60-258078
Jun. 11, 1986 [JP] Japan ..... 61-135390

[51] Int. Cl.[4] ..... C22C 19/05
[52] U.S. Cl. ..... 148/404; 148/410
[58] Field of Search ..... 148/404, 410, 428; 420/445

[56] References Cited

U.S. PATENT DOCUMENTS 4,116,723 9/1978 Gell et al. ..... 148/404

*Primary Examiner*—R. Dean
*Attorney, Agent, or Firm*—Finnegan, Henderson, Farabow, Garrett & Dunner

[57] ABSTRACT

A single-crystal Ni-based super-heat-resistant alloy consisting essentially of, by weight percentage, 4 to 10% of Cr, 4 to 6.5% of Al, 4 to 10% of W, 4 to 9% of Ta, 1.5 to 6% of Mo, and the balance substantially Ni and impurities; or the alloy containing not greater than 12% of Co in addition to the above composition; wherein the contents of W, Ta and Mo are selected to meet the following condition: $\frac{1}{2}.W+\frac{1}{2}.Ta+Mo=9.5\%$ to 13.5%.

6 Claims, No Drawings

SINGLE-CRYSTAL NI-BASED SUPER-HEAT-RESISTANT ALLOY

BACKGROUND OF THE INVENTION

1. Field of the Invention

This invention relates to a single-crystal Ni-based super-heat-resistant alloy which has an improved creep rupture strength and creep rupture ductility and which is used mainly as a material of gas turbine engine blades.

2. Description of the Prior Art

In general, rupture of metals at a high temperatures takes place along grain boundaries. It is therefore possible to greatly increase the creep rupture strength of a turbine blade at high temperatures by using a metal of a single-crystal structure having no grain boundaries and by applying a suitable heat treatment to that metal. The following single-crystal Ni-based super-heat-resistant alloys have been developed from this concept: Alloy 444 (disclosed in U.S. Pat. No. 4,116,723), Alloy 454 (disclosed in U.S. Pat. No. 4,209,348) and Alloy 203E (disclosed in U.S. Pat. No. 4,222,794) by United Technologies Corporation; NASAIR100 by Air Research Corporation; and CMSX-2 (disclosed in Japanese Patent Application Laid-Open Publication No. 89451/82) and CMSX-3 (disclosed in Japanese patent Application Laid-Open Publication No. 190342/84) by Canon Muskegon Corporation. The creep rupture strength of each of these single-crystal alloys is remarkably higher than those of conventional polycrystal alloys, but these single-crystal alloys are still unsatisfactory from the standpoints of compositional balance and structure control. It has been found that, the alloy NASAIR100, for example, precipitates the detrimental phases such as $\alpha$-W phase, $\mu$ phase, etc. thereby reducing the creep rupture strength. In order to prevent the precipitation of the detrimental phases such as $\alpha$-W phase, etc., it is necessary to reduce the amount of W, Mo, Ta, etc. to be added. However too much reduction in contents of these elements results in a reduced creep rupture strength, since these elements are effective in strengthening the alloy.

SUMMARY OF THE INVENTION

An object of the present invention is to provide, by detailedly studying the added amount of each of the alloying elements constituting a single-crystal alloy and the compositional balance between the alloying elements, an alloy having a high creep rupture strength and structural stability as well as an improved creep rupture ductility.

To this end, the present invention provides a single-crystal Ni-based super-heat-resistant alloy consisting essentially of, by weight percentage, 4 to 10% of Cr, 4 to 6.5% of Al, 4 to 10% of W, 4 to 9% of Ta, 1.5 to 6% of Mo, and the balance substantially Ni and impurities, with addition of not greater than 12% of Co as required, wherein the contents of W, Ta and Mo are selected to meet the following condition: $\frac{1}{2}.W+\frac{1}{2}.Ta+Mo=9.5\%$ to 13.5%.

The reasons for limiting the contents of respective components of the alloy according to the present invention will be described below.

Cr acts to improve the oxidization resistance and corrosion resistance of the alloy, but when it is added in excess it causes detrimental precipitation phases such as $\sigma$ phase, etc., thereby reducing the creep rupture strength, so that the Cr content is limited to 4 to 10%.

Al is a principal element which forms an intermetallic compound called $\gamma'$ phase which precipitates to strengthen a Ni-based super-heat-resistant alloy. Although the basic composition of the $\gamma'$ phase is represented by $Ni_3Al$, the alloy can be further strengthened by dissolving Ti, Ta, W, Mo, etc. besides Al into the $\gamma'$ phase. The effect of these elements will be described later. Although a single-crystal alloy contains a large amount of $\gamma'$ phase (generally more than 50% by volume), since when the solidification of the alloy has completed there exist a coarse $\gamma'$ phase called the eutectic $\gamma'$ phase, the alloy is subjected to a solution heat treatment at a high temperature in order to once dissolve this phase into a mother phase (called the $\gamma$ phase). The $\gamma'$ phase which has been dissolved by solution heat treatment is precipitated uniformly and finely during cooling and by a subsequent aging treatment, thereby strengthening the alloy. When Al content is not higher than 4%, an amount of the $\gamma'$ phase to be formed is not sufficient, whereas when Al content is higher than 6.5%, the $\gamma'$ phase is formed so excessively that it becomes impossible to completely dissolve the eutectic $\gamma'$ phase by the solution heat treatment, thus reducing the creep rupture strength. Accordingly, the Al content is limited to 4 to 6.5%.

W is an element which dissolves into the $\gamma$ and $\gamma'$ phases so as to strengthen both phases. It is necessary to add W in an amount of at least 4%, but excessive addition of W causes a phase called the $\alpha$-W phase to precipitate, thereby instead reducing the creep rupture strength. Accordingly, the W content is limited to 4 to 10%.

Ta dissolves mainly into the $\gamma'$ phase so as to strengthen the $\gamma'$ phase and also increase an amount of the $\gamma'$ phase. It is thus necessary to add Ta in an amount of at least 4%, but excessive addition of Ta makes it difficult to dissolve the eutectic $\gamma'$ phase and changes the form of the $\gamma'$ phase, thereby reducing the creep rupture strength. Accordingly, the Ta content is limited to 4 to 9%.

Mo dissolves mainly into the $\gamma$ phase so as to strengthen the $\gamma$ phase, and thus Mo in an amount of at least 1.5% is needed. On the other hand, excess addition of Mo causes the $\alpha$-Mo phase to precipitate, thereby reducing the creep rupture strength. Accordingly, the Mo content is limited to 1.5 to 6%.

It is essential for the above-described there elements W, Ta and Mo to be added together, since they have different strengthening effects. In the present invention, the total amount of these three elements to be added is regulated by the content of $\frac{1}{2}.W+\frac{1}{2}.Ta+Mo$. The coefficients for W and Ta are respectively assumed to be $\frac{1}{2}$, because the composition according to the present invention is based on atomic percentage rather than weight percentage. If the content of $\frac{1}{2}.W+\frac{1}{2}.Ta+Mo$ is lower than 9.5%, the solid solution strengthening effect by the $\gamma$ and $\gamma'$ phases is not sufficient, whereas if it is higher than 13.5%, detrimental phases such as $\alpha$-(W, Mo) phase, etc. may precipitate. Further, even if the content of $\frac{1}{2}.W+\frac{1}{2}.Ta+Mo$ is lower than 13.5%, the $\alpha$-(W, Mo) phase may precipitate if the content of each of the elements W, Ta and Mo to be added is outside the prescribed range. This is observed when the content of W added is very high and the contents of Ta and Mo added are nil or low. Thus, it is important to add these three elements together respectively in an amount larger than the lower limit in the prescribed range of each element, also for the purpose of preventing the α-(W, Mo) phase from precipitation of thus stabilizing the structure.

The precipitation of α-W phase may be observed in the aforesaid NASAIR100 alloy. This is because the W content of this alloy is as high as 10.5%. In the aforesaid CMSX-2 alloy which is an alloy made by improving the NASAIR100 alloy, the precipitation of α-W phase is suppressed by reducing the content of W and instead increasing the Ta content, but the solid solution strengthening effect by W, Ta and Mo is not sufficient yet. In the alloy of the present invention, the solid solution strengthening effect by the γ and γ' phases is maximized in a range within which no detrimental phases such as α-(W, Mo) phase, etc. are formed by means of especially making the content of Mo among the three elements W, Ta and Mo higher than the conventional alloy and regulating the content of each of these three elements and the total content of these three elements.

Addition of Co contributes to an improvement in the creep rupture elongation. This is considered to be attributable to the fact that the stacking fault energy of the alloy is reduced by the addition of Co. However, since excessive addition of Co deteriorates the oxidation resistance of the alloy, the Co content is limited to not higher than 12%.

Further, Ti is frequently contained in a conventional single-crystal alloy. Ti dissolves into the γ' phase and is helpful in the formation of the γ' phase and in the solid solution strengthening, but it is liable to form the eutectic γ' phase and lowers a melting point of the alloy and therefore the solution heat treatment temperature cannot be sufficiently increased, so that addition of Ti makes it difficult to dissolve the γ' phase. For this reason, the alloy according to the present invention does not contain Ti.

In also the alloy according to the present invention, it is necessary to suppress the contents of C, B, Zr, etc. to the impurity level as in the case of other single-crystal alloys, since these elements lower the initial melting point of the alloy.

DESCRIPTION OF THE PREFERRED EMBODIMENTS

Table 1 shows the chemical compositions of samples used for comparing the properties of the alloys according to the present invention with those of the comparative alloys and the conventional alloys, and further shows the creep rupture time and the creep rupture elongation in a creep rupture test carried out at a temperature of 1050° C. under a stress of 15.0 kgf/mm$^2$. The samples used in the creep rupture test were subjected to the following heat treatments, after having been casted as a single crystal. That is, all of the alloys of the present invention and the comparative alloys were subjected to a heat treatment consisting of heating at 1310° to 1345° C. for four hours followed by air-cooling, heating at 1080° C. for five hours followed by air-cooling, and heating at 870° C. for twenty hours followed by air-cooling. The conventional alloy NASAIR100 was subjected to a heat treatment consisting of heating at 1320° for four hours followed by air-cooling, heating at 980° C. for five hours followed by air-cooling, and heating at 870° C. for twenty hours followed by air-cooling. The conventional alloy CMSX-2 was subjected to a heat treatment consisting of heating at 1316° C. for four hours followed by air-cooling, heating at 980° C. for five hours followed by air-cooling, and heating at 870° C. for twenty hours followed by air-cooling.

In both of the alloys according to the present invention and the comparative alloys the content of $\frac{1}{2}$.W+$\frac{1}{2}$.Ta+Mo is within the range of 9.5–13.5%. On the other hand, in each of the alloys according to the present invention its W, Ta and Mo contents are within the ranges of 4–10%, 4–9% and 1.5–6%, respectively, whereas in each of the comparative alloys at least one of its W, Ta and Mo contents is outside the above-specified ranges. Among the comparative alloys, concerning each of the comparative alloys Nos. 1, 2, 5 and 6 having high W content and low or nil Ta content, the precipitation of α-(W, Mo) phase is seen after the heat treatment or during the creep test, so that it exhibits a short creep rupture time. On the other hand, concerning each of the comparative alloys Nos. 3, 4, 7 and 8 having high Ta content and low or nil W content, the precipitation of α-(W, Mo) phase is not seen but the eutectic γ' phase cannot be completely dissolved by the heat treatment and thus a part thereof remains and in addition the shape of γ' phase is changed into a nearly spherical shape, so that it exhibits a short creep rupture time. Further, concerning the comparative alloy No. 9 having high Mo content, the precipitation of α-(W, Mo) phase is not seen but its W and Ta contents are too low, so that it exhibits a short creep rupture time.

In contrast with the above, since each of the alloys according to the present invention contains the three elements W, Ta and Mo in well balanced contents, the precipitation of α-(W, Mo) phase is not seen, so that it exhibits a long creep rupture time. In Table 1 there are shown also the results of creep rupture test for some of the conventional alloys and from these results it is apparent that the alloys according to the present invention are superior.

Further, among the alloys according to the present invention, the alloys Nos. 13 and 14 containing Co exhibit the superior values not only in creep rupture time but also in creep rupture elongation.

Table 2 shows the creep rupture time and the creep rupture elongation in the creep rupture test carried out at a temperature of 1040° C. under a stress of 14.0 kgf/mm$^2$ for some of the alloys of the present invention and the conventional alloys. The heat treatments applied to the samples were as mentioned before. Under these test conditions, each of the alloys according to the present invention exhibits a rupture time of longer than 1500 hours and thus exhibits an extremely higher creep rupture strength than the conventional alloys.

As described above, the alloys according to the present invention have a higher creep rupture strength than the known alloys and a sufficient creep rupture ductility, so that they may be used as materials for gas turbine blades so as to greatly improve the efficiency thereof.

TABLE 1

| Alloy No. | Chemical Composition (wt %) Cr | Al | W | Ta | Mo | Ti | Co | Ni | $\frac{1}{2}$ · W + $\frac{1}{2}$ · Ta + Mo | Creep Rupture Time (h) | Creep Rupture Elongation (%) |
|---|---|---|---|---|---|---|---|---|---|---|---|
| Alloy of the | | | | | | | | | | | |

TABLE 1-continued

| Alloy No. | Chemical Composition (wt %) Cr | Al | W | Ta | Mo | Ti | Co | Ni | ½·W + ½·Ta + Mo | Creep Rupture Time (h) | Creep Rupture Elongation (%) |
|---|---|---|---|---|---|---|---|---|---|---|---|
| Present Invention | | | | | | | | | | | |
| 1 | 6.6 | 5.5 | 7.9 | 4.6 | 5.4 | — | — | Bal | 11.7 | 462 | 6.2 |
| 2 | 6.7 | 5.2 | 4.7 | 8.2 | 5.3 | — | — | Bal | 11.8 | 413 | 8.9 |
| 3 | 6.6 | 5.2 | 7.1 | 7.5 | 4.4 | — | — | Bal | 11.7 | 488 | 7.7 |
| 4 | 6.7 | 6.0 | 8.8 | 5.6 | 3.0 | — | — | Bal | 10.2 | 454 | 6.6 |
| 5 | 6.5 | 5.8 | 7.3 | 7.1 | 2.9 | — | — | Bal | 10.1 | 395 | 5.4 |
| 6 | 6.6 | 5.6 | 5.3 | 8.8 | 2.9 | — | — | Bal | 10.0 | 331 | 10.1 |
| 7 | 6.5 | 6.0 | 7.8 | 8.1 | 1.7 | — | — | Bal | 9.7 | 347 | 5.9 |
| 8 | 6.8 | 5.8 | 5.3 | 5.5 | 4.8 | — | — | Bal | 10.2 | 472 | 6.5 |
| 9 | 6.9 | 5.8 | 5.7 | 6.2 | 5.1 | — | — | Bal | 11.1 | 520 | 7.9 |
| 10 | 6.7 | 5.3 | 6.0 | 6.4 | 5.4 | — | — | Bal | 11.6 | 453 | 5.1 |
| 11 | 6.5 | 4.8 | 6.8 | 6.8 | 5.6 | — | — | Bal | 12.4 | 617 | 9.5 |
| 12 | 6.4 | 4.6 | 6.9 | 7.4 | 5.8 | — | — | Bal | 13.0 | 481 | 4.8 |
| 13 | 5.9 | 5.1 | 7.4 | 7.3 | 4.2 | — | 5.6 | Bal | 11.6 | 535 | 15.2 |
| 14 | 5.4 | 5.3 | 7.3 | 7.1 | 4.3 | — | 10.3 | Bal | 11.5 | 451 | 20.4 |
| Comparative Alloy | | | | | | | | | | | |
| 1 | 6.7 | 6.4 | 11.0 | — | 4.8 | — | — | Bal | 10.3 | 156 | 6.2 |
| 2 | 6.8 | 5.9 | 8.3 | 2.8 | 4.8 | — | — | Bal | 10.4 | 232 | 5.1 |
| 3 | 7.0 | 5.9 | 2.5 | 8.1 | 4.8 | — | — | Bal | 10.1 | 211 | 14.8 |
| 4 | 7.0 | 5.4 | — | 10.3 | 4.8 | — | — | Bal | 10.0 | 94 | 15.3 |
| 5 | 6.8 | 6.3 | 14.4 | — | 3.0 | — | — | Bal | 10.2 | 137 | 8.8 |
| 6 | 6.6 | 6.0 | 10.3 | 3.6 | 3.0 | — | — | Bal | 10.0 | 255 | 8.3 |
| 7 | 6.9 | 5.7 | 3.4 | 10.7 | 3.0 | — | — | Bal | 10.1 | 199 | 17.7 |
| 8 | 6.8 | 5.4 | — | 14.3 | 2.9 | — | — | Bal | 10.1 | 103 | 13.3 |
| 9 | 7.2 | 6.0 | 3.6 | 3.8 | 6.4 | — | — | Bal | 10.1 | 243 | 9.2 |
| *NASAIR | 9.0 | 5.8 | 10.5 | 3.3 | 1.0 | 1.2 | — | Bal | 7.9 | 220 | 9.3 |
| CMSX-2 | 8.0 | 5.6 | 8.0 | 6.0 | 0.6 | 1.0 | 4.6 | Bal | 7.6 | 150 | 13.1 |

*Conventional Alloy

TABLE 2

| Alloy No. | | Creep Rupture Time (hours) | Creep Rupture Elongation (%) |
|---|---|---|---|
| Alloy of the Present Invention | 3 | 3107 | 4.8 |
| | | 1746 | 7.5 |
| | 9 | 2482 | 4.6 |
| | | 2404 | 5.8 |
| Conventional Alloy | NASAIR100 | 574 | 10.9 |
| | CMSX-2 | 399 | 11.8 |

What is claimed is:

1. A single-crystal Ni-based super-heat-resistant alloy consisting essentially of, by weight percentage, 4 to 10% of Cr, 4 to 6.5% of Al, 4 to 10% of W, 4 to 9% of Ta, 2.9 to 6% of Mo, greater than impurity levels of 0.5% and not greater than 12% of Co, and the balance substantially Ni and impurities, wherein the contents of W, Ta and Mo are selected to meet the following conditions: $\frac{1}{2}$:W+$\frac{1}{2}$:Ta+Mo=9.5 to 13.5%; and at least one of Ta and W being less than 8%.

2. The single-crystal Ni-based super-heat-resistant alloy according to claim 1, consisting essentially of, by weight percentage, 4.5 to 8.5% of Cr, 4 to 6% of Al, 5 to 8% of W, 5 to 8% of Ta, 3.5 to 5.5% of Mo, greater than impurity levels of 0.5% and not greater than 12% of Co, and the balance substantially Ni and impurities, wherein the contents of W, Ta and Mo are selected to meet the following condition: $\frac{1}{2}$:W+$\frac{1}{2}$:Ta+Mo=10 to 13%.

3. A single-crystal Ni-based super-heat-resistant alloy consisting essentially of, by weight percentage, 4 to 10% of Cr, 4 to 6.5% of Al, 4 to 10% of W, 4 to 9% of Ta, 1.5 to 6% of Mo, not greater than 12% of Co, and the balance substantially Ni and impurities, wherein the contents of W, Ta and Mo are selected to meet the following condition: $\frac{1}{2}$.W+$\frac{1}{2}$.Ta+Mo=9.5 to 13.5%, wherein the alloy specifically includes about 5.9% of Cr, about 5.1% of Al, about 7.3% of W, about 7.3% of Ta, about 4.3% of Mo, about 5.6% of Co, and the balance substantially Ni and impurities.

4. A single-crystal Ni-based super-heat-resistant alloy consisting essentially of, by weight percentage, 4 to 10% of Cr, 4 to 6.5% of Al, 4 to 10% of W, 4 to 9% of Ta, 1.5 to 6% of Mo, not greater than 12% of Co, and the balance substantially Ni and impurities, wherein the contents of W, Ta and Mo are selected to meet the following condition: $\frac{1}{2}$.W+$\frac{1}{2}$.Ta+Mo=9.5 to 13.5%, wherein the alloy specifically includes about 5.4% of Cr, about 5.1% of Al, about 7.3% of W, about 7.3% of Ta, about 4.3% of Mo, about 10.3% of Co, and the balance substantially Ni and impurities.

5. A single-crystal Ni-based super-heat-resistant alloy according to claim 1, consisting essentially of, by weight percentage, about 5.9% of Cr, about 5.1% of Al, about 7.3% of W, about 7.3% of Ta, about 4.3% of Mo, about 5.6% of Co, and the balance substantially Ni and impurities.

6. A single-crystal Ni-based super-heat-resistant alloy according to claim 1, consisting essentially of, by weight percentage, about 5.4% of Cr, about 5.1% of Al, about 7.3% of W, about 7.3% of Ta, about 4.3% of Mo, about 10.3% of Co, and the balance substantially Ni and impurities.

* * * * *